US008707726B2

(12) United States Patent
Lim et al.

(10) Patent No.: US 8,707,726 B2
(45) Date of Patent: Apr. 29, 2014

(54) REFRIGERATOR

(75) Inventors: Jae Hoon Lim, Suwon-si (KR); So Hyun Min, Gwangju (KR); Myung Ju Sim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 488 days.

(21) Appl. No.: 13/064,387

(22) Filed: Mar. 22, 2011

(65) Prior Publication Data

US 2011/0239687 A1 Oct. 6, 2011

(30) Foreign Application Priority Data

Apr. 5, 2010 (KR) ..... 10-2010-0031049

(51) Int. Cl.
*F25C 5/18* (2006.01)

(52) U.S. Cl.
USPC ..... 62/344

(58) Field of Classification Search
USPC ..... 62/340, 344, 440, 449
See application file for complete search history.

(56) References Cited

U.S. PATENT DOCUMENTS

| | | | | |
|---|---|---|---|---|
| 6,148,624 | A | 11/2000 | Bishop et al. | |
| 2004/0148957 | A1 * | 8/2004 | Pohl et al. | 62/347 |
| 2009/0229284 | A1 * | 9/2009 | Fulton | 62/137 |
| 2009/0235681 | A1 * | 9/2009 | Petrenko et al. | 62/351 |

FOREIGN PATENT DOCUMENTS

| | | |
|---|---|---|
| JP | 2001-248961 | 9/2001 |
| KR | 10-2004-0105176 | 12/2004 |
| KR | 10-2007-0096516 | 10/2007 |
| WO | 2006/011116 | 2/2006 |
| WO | 2007/066958 | 6/2007 |
| WO | 2008/032986 | 3/2008 |

* cited by examiner

*Primary Examiner* — Melvin Jones
(74) *Attorney, Agent, or Firm* — Staas & Halsey LLP

(57) ABSTRACT

A refrigerator including a main body provided with a freezing chamber, a freezing chamber door to open and close the freezing chamber, a subsidiary door to open and close an opening provided on the freezing chamber door, and an ice maker installed on the rear surface of the subsidiary door to manufacture ice. As the opening is opened by the subsidiary door, the ice maker is drawn out of the freezing chamber, thereby enabling a user to conveniently supply water to the inside of the ice maker or to conveniently use the ice manufactured by the ice maker.

16 Claims, 6 Drawing Sheets

REFRIGERATOR

CROSS-REFERENCE TO RELATED APPLICATIONS

This application claims the benefit of Korean Patent Application No. 2010-0031049, filed on Apr. 5, 2010 in the Korean Intellectual Property Office, the disclosure of which is incorporated herein by reference.

BACKGROUND

1. Field

Embodiments relate to a refrigerator having an ice maker to manufacture ice.

2. Description of the Related Art

In general, a refrigerator is an apparatus which includes components of a refrigerating cycle so as to store articles in a frozen state or a refrigerated state using cool air generated from an evaporator of the refrigerating cycle.

Such a refrigerator includes a main body including a freezing chamber to store articles, such as food, in the frozen state, and a freezing chamber door rotatably installed at one side of the main body to open and close the freezing chamber, and an ice maker which manufactures ice using cool air transmitted from the inside of the freezing chamber is installed in the freezing chamber. The ice maker includes an ice tray provided with a plurality of ice making grooves to manufacture ice, and an ice storage container to contain and store the ice manufactured by the ice tray.

SUMMARY

Therefore, it is an aspect to provide a refrigerator having an ice maker which more conveniently manufactures ice.

Additional aspects will be set forth in part in the description which follows and, in part, will be apparent from the description, or may be learned by practice of the invention.

In accordance with one aspect, a refrigerator includes a main body, a freezing chamber provided in the main body, a freezing chamber door to open and close the freezing chamber, an opening provided on the freezing chamber door, a subsidiary door, one side end of which is rotatably installed at one side of the opening of the freezing chamber door and rotated in the horizontal direction to open and close the opening, and an ice maker installed on the rear surface of the subsidiary door, wherein the ice maker includes an ice tray to manufacture ice, an ice storage container disposed under the ice tray to store the ice manufactured by the ice tray, and an ice making case forming an external appearance of the ice maker to receive the ice tray in the upper portion of the ice making case and to receive the ice storage container in the lower portion of the ice making case.

The ice maker may further include a cover separably installed on the ice making case to cover the ice tray, and the ice tray is rotatably installed on the cover and thus is separated from the ice making case together with the cover.

In accordance with another aspect, a refrigerator includes a main body, a freezing chamber provided in the main body, a freezing chamber door to open and close the freezing chamber, an opening provided on the freezing chamber door, a subsidiary door to open and close the opening, and an ice maker installed on the rear surface of the subsidiary door and drawn out of the freezing chamber as the opening is opened.

One side end of the subsidiary door may be rotatably installed at one side of the opening of the freezing chamber door, and thus be rotated in the horizontal direction to open and close the opening.

The refrigerator may further include a latch formed at the other side of the subsidiary door to maintain the closed state of the opening with the subsidiary door.

The ice maker may include an ice tray provided with ice making grooves to manufacture ice, and an ice storage container disposed under the ice tray to store the ice manufactured by the ice tray.

The ice maker may further include an ice making case forming an external appearance of the ice maker, and thus the ice tray may be received in the upper portion of the ice making case and the ice storage container may be received in the lower portion of the ice making case.

The ice maker may further include a cover separably installed on the upper portion of the ice making case to cover the ice tray, and the ice tray may be rotatably installed on the cover.

The ice tray may include a pair of hinge shafts provided on both sides thereof to rotatably install the ice tray on the cover, and a rotary lever connected to any one hinge shaft of the pair of hinge shafts and disposed at the outside of the ice making case to receive external force, and the cover may include a pair of hinge parts on which the pair of hinge shafts is rotatably installed.

The ice tray may further include an ice removing shaft separated from any one shaft of the pair of hinge shafts, and an ice removing guide connected to the one shaft of the pair of hinge shafts and the ice removing shaft, and the ice making case may include a projection provided on a rotating route of the ice removing guide so as to be caught on the ice removing guide.

The cover may include a lid part to cover the ice tray, and a pair of guide parts extended backwardly from both sides of the lid part, and the ice making case may include a pair of guide grooves provided on both inner side surfaces thereof such that the pair of guide parts is movably installed in the pair of guide grooves.

The ice maker may further include fixing protrusions protruded from any one of the pair of guide parts and the pair of guide grooves, and fixing holes provided on the other one of the pair of guide parts and the pair of guide grooves.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
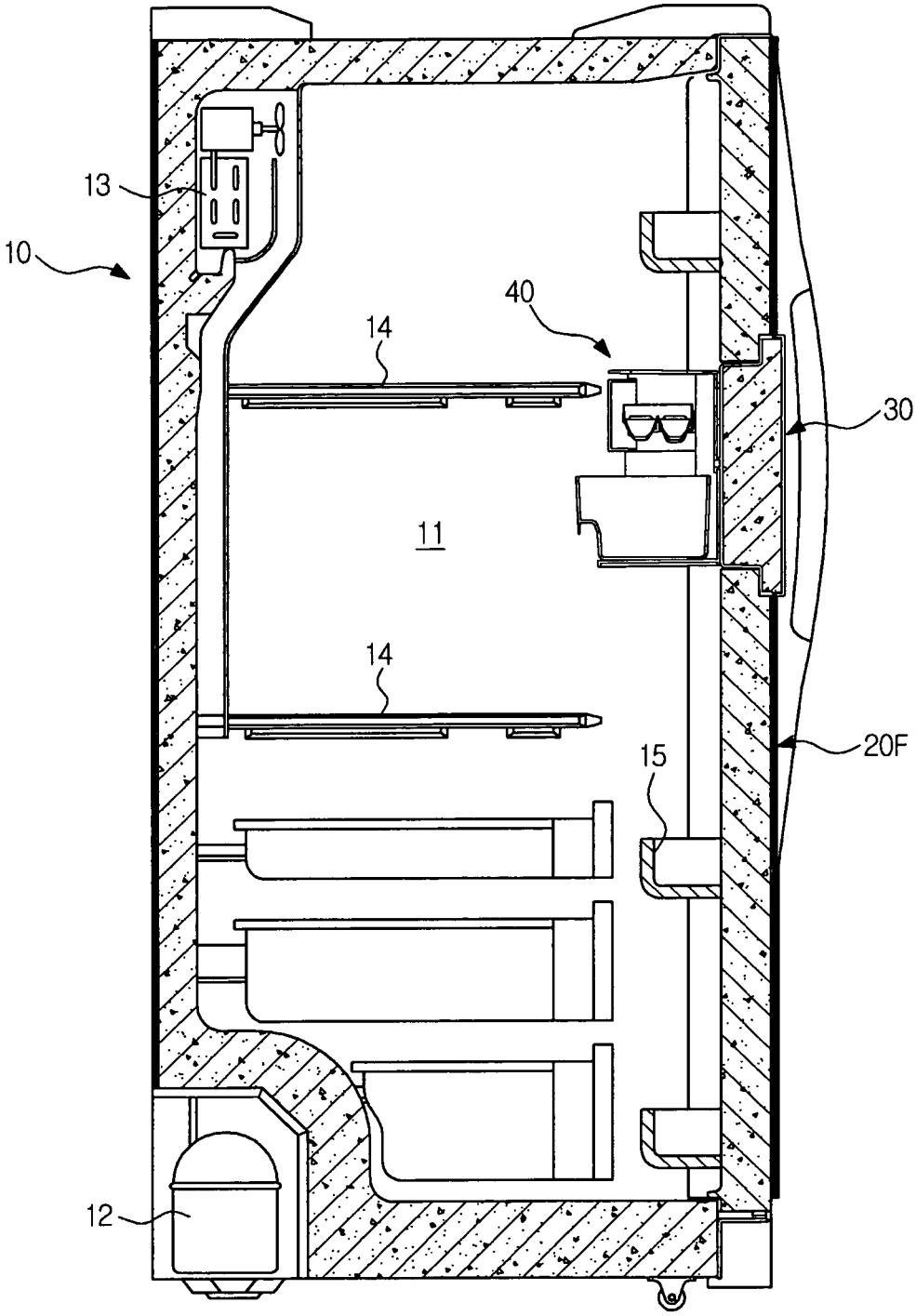
FIG. 1 is a longitudinal-sectional view of a refrigerator in accordance with one embodiment.

Reference will now be made in detail to the embodiments, examples of which are illustrated in the accompanying drawings, wherein like reference numerals refer to like elements throughout.

Figure 2:
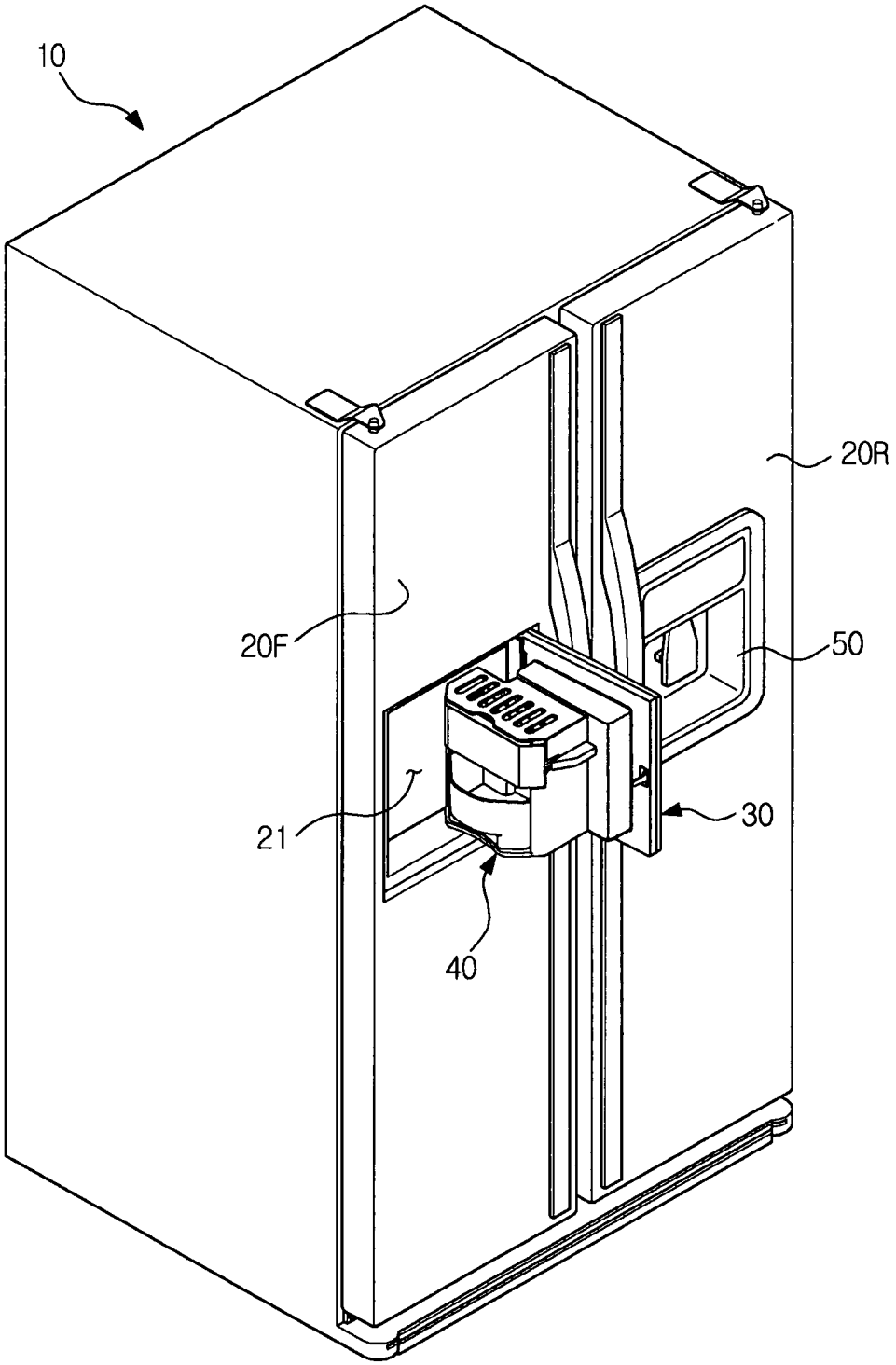
FIG. 2 is a perspective view of the refrigerator in accordance with the embodiment.

As shown in FIGS. 1 and 2, a refrigerator in accordance with one embodiment includes a main body 10 forming an external appearance of the refrigerator and provided with the inside horizontally divided into a refrigerating chamber (not shown) to store articles in a refrigerated state and a freezing chamber 11 to store articles in a frozen state, and a refrigerating chamber door 20R and a freezing chamber door 20F provided with side ends respectively hinged to both sides of the main body 10 and rotated to respectively open and close the refrigerating chamber and the freezing chamber 11.

Components of a refrigerating cycle, i.e. a compressor 12 to compress a refrigerant, a condenser (not shown) to cool the refrigerant through heat exchange of the refrigerant with air at the outside of the main body 10, an expansion valve (not shown) to decompress and expand the refrigerant, and an evaporator 13 disposed at the rear portion of the refrigerating chamber or the freezing chamber 11 to generate cool air by absorbing heat from air at the inside of the refrigerating chamber of the freezing chamber 11, are installed in the refrigerating chamber and the freezing chamber 11 of the main body 10. The articles stored in the refrigerating chamber or the freezing chamber 11 are maintained at a low temperature by the cool air generated from the evaporator 13.

Plural racks 14 vertically separated from each other to vertically divide the insides of the refrigerating chamber and the freezing chamber 11 so as to efficiently store various articles are disposed in the refrigerating chamber and the freezing chamber 11, and door racks 15 to store articles, such as drinks, are disposed on the inner surfaces of the refrigerating chamber door 20R and the freezing chamber door 20F.

An opening 21 to take the stored articles out of the inside of the freezing chamber 11 without completely opening the freezing chamber 11 is provided on the freezing chamber door 20F, and a subsidiary door 30 to open and close the opening 21 is provided. On the other hand, a dispenser 50 to supply water is installed on the refrigerating chamber door 20R.

One side end of the subsidiary door 30 is rotatably installed at one side of the opening 21 of the freezing chamber door 20F, and thus is rotated in the horizontal direction to open and close the opening 21. A latch 31 fixed to the freezing chamber door 20F to maintain the closed state of the opening 21 with the subsidiary door 30 is protruded from the rear surface of the other side of the subsidiary door 30.

An ice maker 40 to manufacture ice is installed on the rear surface of the subsidiary door 30. If the ice maker 40 is installed on the rear surface of the subsidiary door 30, the ice maker 40 installed on the rear surface of the subsidiary door 30 is drawn from the freezing chamber 11 to the outside of the freezing chamber door 20F through the opening 21 as the subsidiary door 30 is rotated to open and opening 21, thereby enabling a user to supply water to the ice maker 40 or to pull the ice manufactured by the ice maker 40 out without opening the freezing chamber door 20F.

Figure 3:
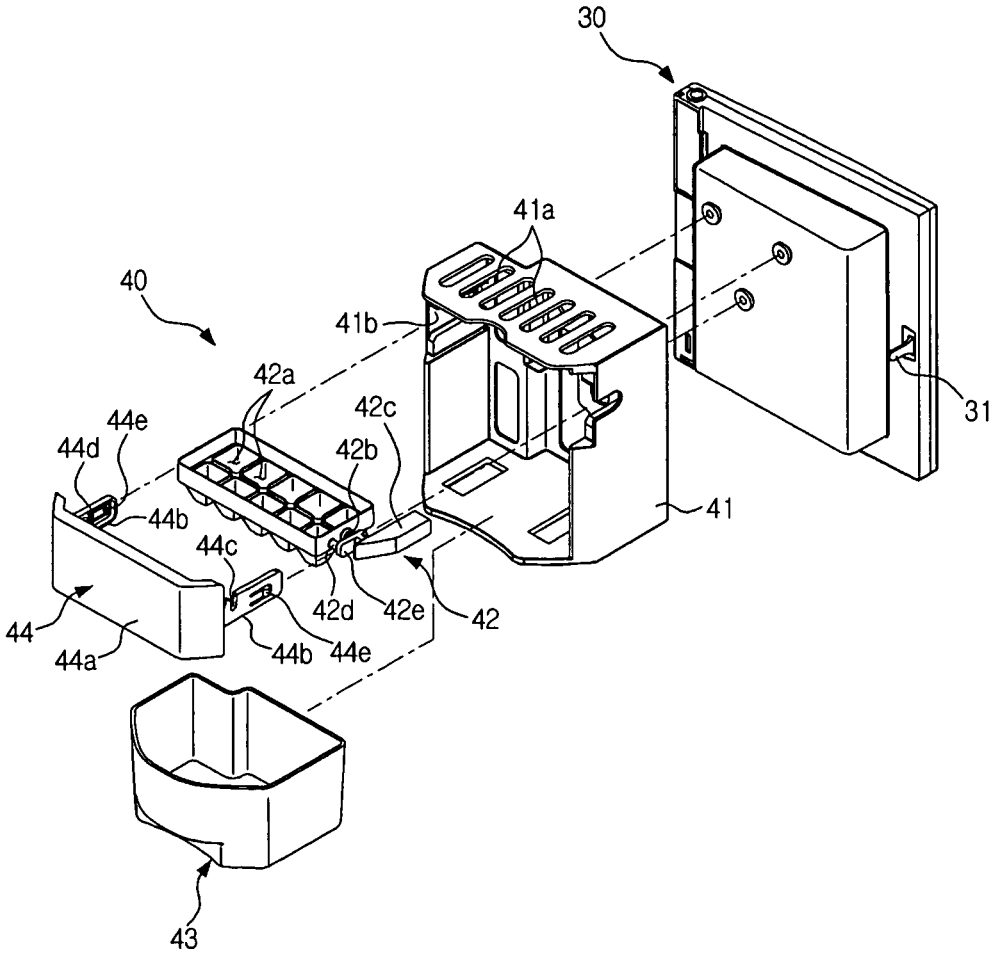
FIG. 3 is an exploded perspective view of an ice maker applied to the refrigerator in accordance with the embodiment.

As shown in FIG. 3, the ice maker 40 includes an ice tray 42 installed on the upper portion of rear surface of the subsidiary door 30 and provided with a plurality of ice making grooves 42*a* formed on the upper surface of the ice tray 42 to manufacture ice, an ice storage container 43 installed on the lower portion of the rear surface of the subsidiary door 30 and disposed under the ice tray 42 to receive and store ice removed from the ice tray 42, an ice making case 41, the rear end of which is installed on the rear surface of the subsidiary door 30 such that the ice tray 42 is received in the upper portion of the ice making case 41 and the ice storage container 43 is received in the lower portion of the ice making case 41, and a cover 44 installed on the upper portion of the ice making case 41 to cover the ice tray 42 received in the upper portion of the ice making case 41.

The front portion of the ice making case 41 facing the inside of the freezing chamber 11 is opened so as to receive the ice tray 42 and the ice storage container 43, and a plurality through holes 41 a is provided on the upper surface of the ice making case 41 so as to transmit cool air of the freezing chamber 11 to the ice tray 42. Therefore, water contained in the ice making grooves 42*a* of the ice tray 42 is frozen into ice by the cool air transmitted to the inside of the ice tray 42 via the through holes 41*a*, and ice removed from the ice making grooves 42*a* of the ice tray 42 falls down to the ice storage container 43 and is stored in the ice storage container 43.

The ice tray 42 is separably installed in the ice making case 41, and thus is separated from the ice making case 41 so as to supply water to the inside of the ice tray 42 from the outside of the ice maker 40. In this embodiment, the cover 44 is separably installed on the ice making case 41, and the ice tray 42 is rotatably installed on the cover 44 so as to be separated from the ice making case 41 together with the cover 44.

Figure 4:
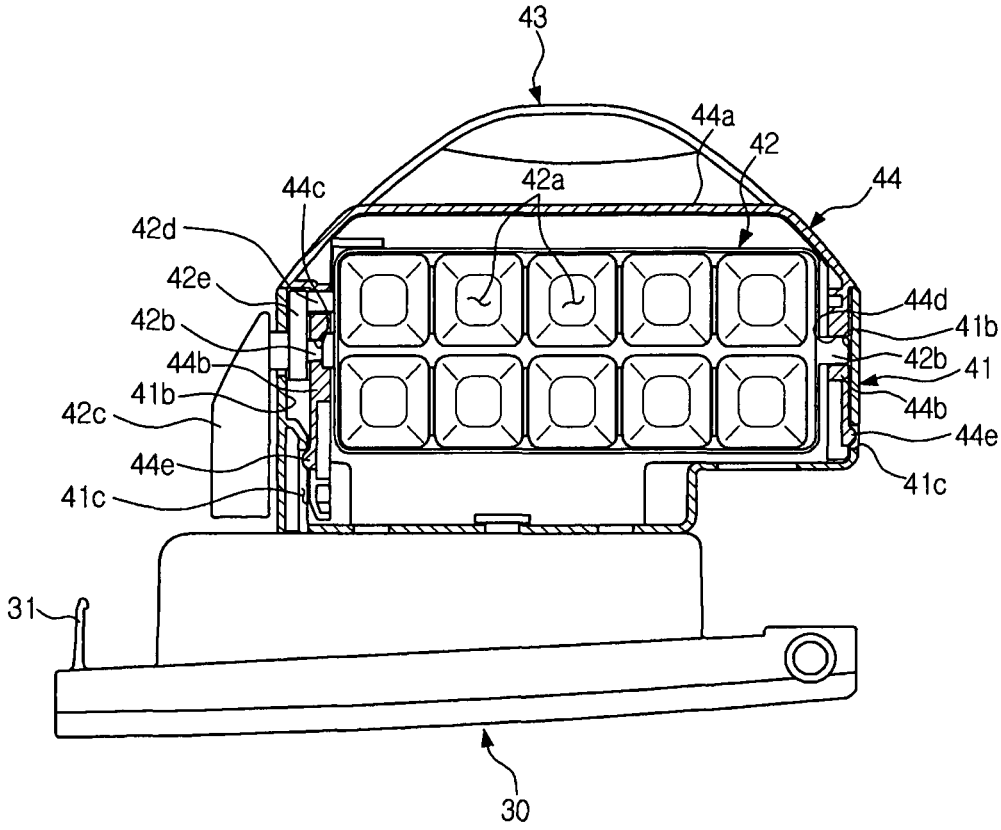
FIG. 4 is a transversal-sectional view of the ice maker applied to the refrigerator in accordance with the embodiment.

The cover 44 includes a lid part 44*a* to cover the front portion of the ice tray 42, and a pair of guide parts 44*b* extended backwardly from both sides of the lid part 44*a* and movably installed on the ice making case 41. As shown in FIG. 4, a guide groove 41*b* to guide each guide part 44*b* is provided on each of both inner side surfaces of the ice making case 41. A hinge shaft 42*b* is provided on each of both sides of the ice tray 42 so as to rotatably install the ice tray 42 on the cover 44, and a pair of hinge parts 44*c* and 44*d* on which the two hinge shafts 42*b* are respectively installed is provided on the guide parts 44*b* of the cover 44. In this embodiment, one hinge part 44*c* of the two hinge parts 44*c* and 44*d* is formed in the shape of a groove and the other hinge part 44*d* of the two hinge parts 44*c* and 44*d* is formed in the shape of a hole, thereby allowing the ice tray 42 to be installed on the guide parts 44*b* of the cover 44 or to be separated from the guide parts 44*b* of the cover 44.

Fixing protrusions 44*e* and fixing holes 41*c* fixed to each other to maintain the installed state of the cover 44 on the ice making case 41 unless force of a designated degree or more is applied to the cover 44 are provided on the rear ends of the guide parts 44*b* and on the inner surfaces of the guide grooves 41*b*. In this embodiment, the fixing protrusions 44*e* are provided on the rear ends of the guide parts 44*b*, and the fixing holes 41*c* are provided on the inner surfaces of the guide grooves 41*b*.

A rotary lever 42*c*, which is disposed at the outside of the ice making case 41, and, to which external force from a user is transmitted, is connected to any one hinge shaft 42*b* of the two hinge shafts 42*b* of the ice tray 42 so as to remove the ice manufactured by the ice making grooves 42*a* of the ice tray 42 from the ice tray 42. Therefore, the ice making case 41 is rotated according to rotation of the rotary lever 42*c*.

Figure 5:
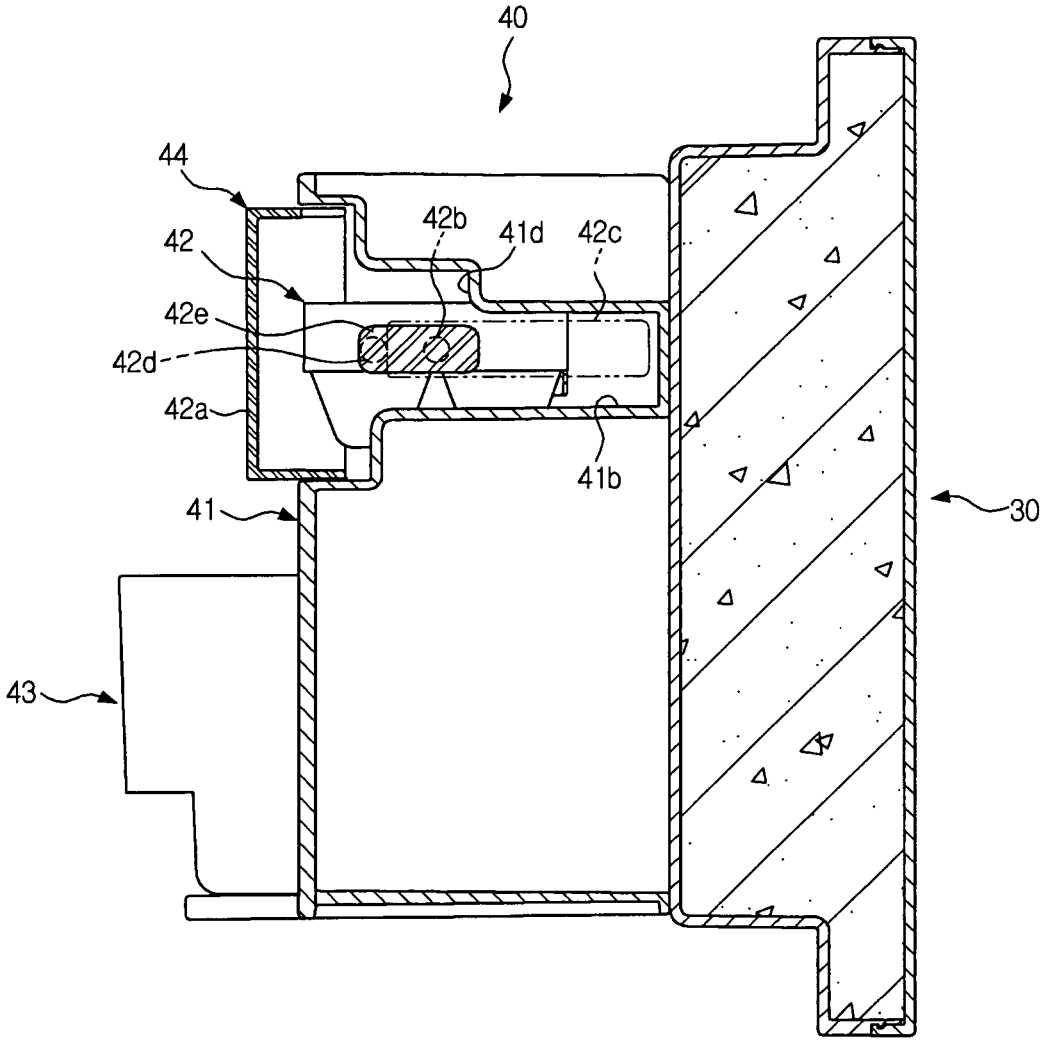
FIGS. 5 and 6 are longitudinal-sectional views illustrating an ice removing process of the ice maker applied to the refrigerator in accordance with the embodiment.

The ice tray 42 includes an ice removing shaft 42*d* separated from the hinge shaft 42*b*, to which the rotary lever 42*c* is connected, by a designated distance, and an ice removing guide 42*d* provided with one end connected to the hinge shaft 42*b*, to which the rotary lever 42*c* is connected, and the other end connected to the ice removing shaft 42*d*. A projection 41*d* caught on the ice removing guide 42*e* is provided on a rotating route of the ice removing guide 42*e* at one side of the inside of the ice making case 41, as shown in FIG. 5.

Figure 6:
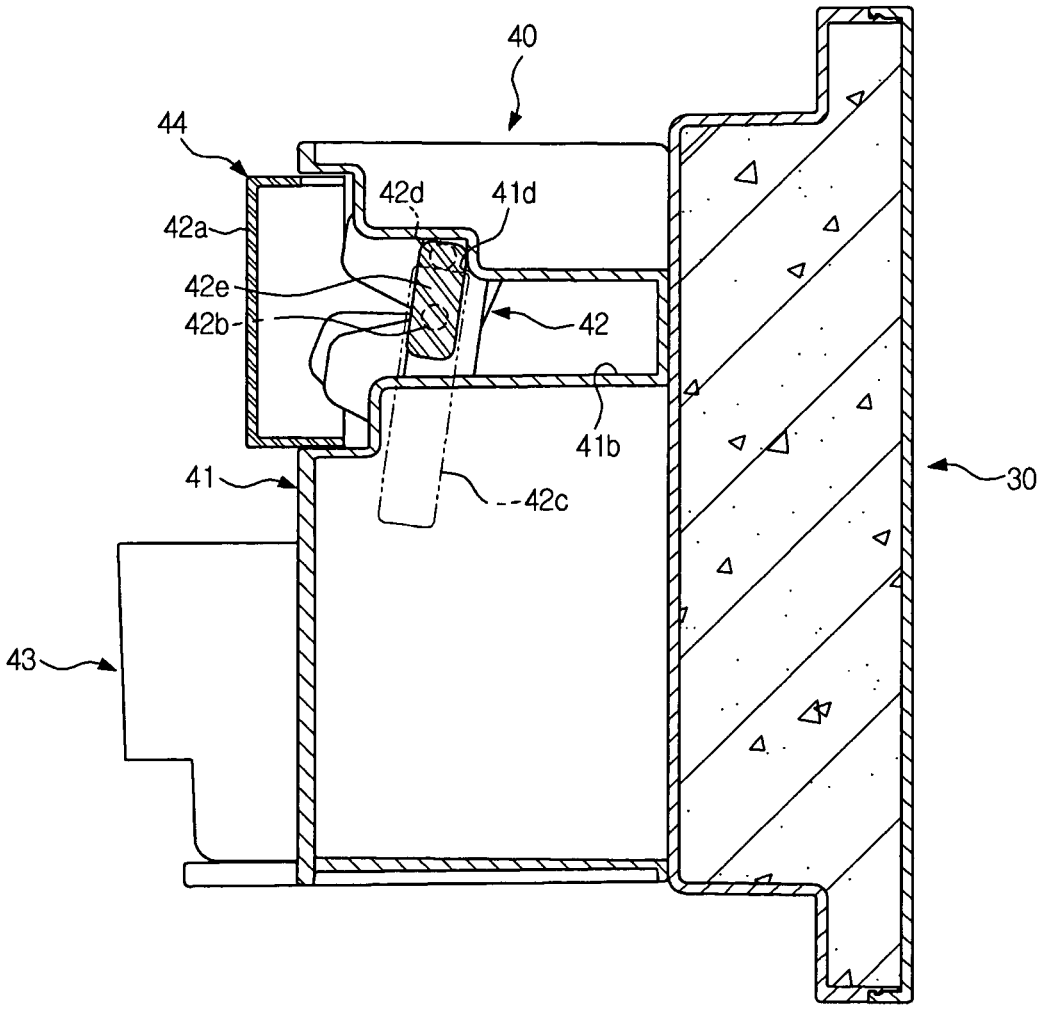

Therefore, if ice is manufactured under the condition that the ice making grooves 42*a* of the ice tray 42 face upward and then the ice needs to be removed from the ice making grooves 42*a*, the rotary lever 42*c* is rotated by force applied thereto, as shown in FIG. 6, and thus the ice tray 42 and the ice removing guide 42*e* are rotated together with the rotation of the rotary lever 42*c*.

During the rotation of the ice removing guide 42*e*, the ice removing guide 42*e* is caught on the projection 41*d*. When force is continuously applied to the rotary lever 42*c* under the above state, one side of the ice tray 42 provided with the ice removing guide 42*e* and the ice removing shaft 42*d* and being adjacent to the rotary lever 42*c* is temporarily deformed, but the other side of the ice tray 42 being distant from the rotary lever 42*c* is scarcely deformed. Therefore, the ice tray 42 is generally warped, and thereby the shapes of the ice making grooves 42*a* are temporarily deformed. According to the deformation of the ice making grooves 42*a*, the ice manufactured in the ice making grooves 42*a* is removed from the ice making grooves 42*a*.

As is apparent from the above description, a refrigerator having an ice maker in accordance with one embodiment allows the ice maker to be drawn out of a freezing chamber through an opening formed on a freezing chamber door without opening the freezing chamber door so as to allow water to be supplied to the inside of the ice maker or ice manufactured by the ice maker to be used, thereby enabling convenient use of the ice maker by a user.

Further, the refrigerator in accordance with the embodiment reduces cool air loss of the freezing chamber generated during the process of supplying water to the inside of the ice maker or using the ice manufactured by the ice maker.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body;

a freezing chamber provided in the main body;

a freezing chamber door to open and close the freezing chamber;

an opening provided on the freezing chamber door;

a subsidiary door, one side end of which is rotatably installed at one side of the opening of the freezing chamber door and rotated in the horizontal direction to open and close the opening; and an ice maker installed on the rear surface of the subsidiary door, wherein the ice maker includes an ice tray to manufacture ice, an ice storage container disposed under the ice tray to store the ice manufactured by the ice tray, and an ice making case forming an external appearance of the ice maker to receive the ice tray in the upper portion of the ice making case and to receive the ice storage container in the lower portion of the ice making case.

2. The refrigerator according to claim 1, wherein the ice maker further includes a cover separably installed on the ice making case to cover the ice tray, and the ice tray is rotatably installed on the cover and thus is separated from the ice making case together with the cover.

3. A refrigerator comprising:

a main body;

a freezing chamber provided in the main body;

a freezing chamber door to open and close the freezing chamber;

an opening provided on the freezing chamber door;

a subsidiary door to open and close the opening; and an ice maker installed on the rear surface of the subsidiary door and drawn out of the freezing chamber as the opening is opened, wherein one side end of the subsidiary door is rotatably installed at one side of the opening of the freezing chamber door, and thus is rotated in the horizontal direction to open and close the opening.

4. The refrigerator according to claim 3, further comprising a latch formed at the other side of the subsidiary door to maintain the closed state of the opening with the subsidiary door.

5. A refrigerator comprising:

a main body;

a freezing chamber provided in the main body;

a freezing chamber door to open and close the freezing chamber;

an opening provided on the freezing chamber door;

a subsidiary door to open and close the opening; and an ice maker installed on the rear surface of the subsidiary door and drawn out of the freezing chamber as the opening is opened, wherein the ice maker includes an ice tray provided with ice making grooves to manufacture ice, and an ice storage container disposed under the ice tray to store the ice manufactured by the ice tray.

6. The refrigerator according to claim 5, wherein the ice maker further includes an ice making case forming an external appearance of the ice maker, and thus the ice tray is received in the upper portion of the ice making case and the ice storage container is received in the lower portion of the ice making case.

7. The refrigerator according to claim 6, wherein the ice maker further includes a cover separably installed on the upper portion of the ice making case to cover the ice tray, and the ice tray is rotatably installed on the cover.

8. The refrigerator according to claim 7, wherein:

the ice tray includes a pair of hinge shafts provided on both sides thereof to rotatably install the ice tray on the cover, and a rotary lever connected to any one hinge shaft of the pair of hinge shafts and disposed at the outside of the ice making case to receive external force; and the cover includes a pair of hinge parts on which the pair of hinge shafts is rotatably installed.

9. The refrigerator according to claim 8, wherein:

the ice tray further includes an ice removing shaft separated from any one shaft of the pair of hinge shafts, and an ice removing guide connected to the one shaft of the pair of hinge shafts and the ice removing shaft; and the ice making case includes a projection provided on a rotating route of the ice removing guide so as to be caught on the ice removing guide.

10. The refrigerator according to claim 7, wherein:

the cover includes a lid part to cover the ice tray, and a pair of guide parts extended backwardly from both sides of the lid part; and the ice making case includes a pair of guide grooves provided on both inner side surfaces thereof such that the pair of guide parts is movably installed in the pair of guide grooves.

11. The refrigerator according to claim 10, wherein the ice maker further includes fixing protrusions protruded from any one of the pair of guide parts and the pair of guide grooves, and fixing holes provided on the other one of the pair of guide parts and the pair of guide grooves.

12. An ice maker installed on a rear surface of a subsidiary door of a freezing chamber of a refrigerator, the ice maker comprising:

an ice tray to manufacture ice;

an ice storage container disposed under the ice tray to store the ice manufactured by the ice tray;

an ice making case forming an external appearance of the ice maker to receive the ice tray in the upper portion of the ice making case and to receive the ice storage container in the lower portion of the ice making case; and a cover separably installed on the upper portion of the ice making case to cover the ice tray, and the ice tray being rotatably installed on the cover.

13. The ice maker according to claim 12, wherein the ice tray includes a pair of hinge shafts provided on both sides thereof to rotatably install the ice tray on the cover, and a rotary lever connected to any one hinge shaft of the pair of hinge shafts and disposed at the outside of the ice making case to receive external force; and the cover includes a pair of hinge parts on which the pair of hinge shafts is rotatably installed.

14. The ice maker according to claim 13, wherein the ice tray includes an ice removing shaft separated from any one shaft of the pair of hinge shafts, and an ice removing guide connected to the one shaft of the pair of hinge shafts and the ice removing shaft, and the ice making case includes a projection provided on a rotating route of the ice removing guide so as to be caught on the ice removing guide.

15. The ice maker according to claim 14, wherein the cover includes a lid part to cover the ice tray, and a pair of guide parts extended backwardly from both sides of the lid part, and the ice making case includes a pair of guide grooves provided on both inner side surfaces thereof such that the pair of guide parts is movably installed in the pair of guide grooves.

16. The ice maker according to claim 15, further comprising:

fixing protrusions protruded from any one of the pair of guide parts and the pair of guide grooves; and fixing holes provided on the other one of the pair of guide parts and the pair of guide grooves.

* * * * *